United States Patent [19]

Paulson

[11] 3,990,365

[45] Nov. 9, 1976

[54] CYLINDER MOISTENING DEVICE

[76] Inventor: Harold E. Paulson, 5369 Vernon Lake Drive, Dunwoody, Ga. 30338

[22] Filed: Sept. 17, 1975

[21] Appl. No.: 614,269

[52] U.S. Cl. ..... 101/147; 101/425; 239/431; 239/432; 239/563

[51] Int. Cl.[2] ..... B41L 25/06

[58] Field of Search ..... 101/147, 148, 425; 239/431, 432, 563, 379

[56] References Cited

UNITED STATES PATENTS

| | | | |
|---|---|---|---|
| 2,622,520 | 12/1952 | Hanser et al. | 101/147 |
| 2,689,523 | 9/1954 | Koch | 101/147 |
| 2,853,941 | 9/1958 | Brandt et al. | 101/147 |
| 2,865,671 | 12/1958 | Jensen | 239/379 |
| 2,994,482 | 8/1961 | Valois et al. | 239/563 |
| 3,143,065 | 8/1964 | Warczak | 101/147 |
| 3,182,867 | 5/1965 | Barosko et al. | 239/563 |
| 3,233,997 | 2/1966 | Moreau | 239/563 |
| 3,411,718 | 11/1968 | Wagner | 101/147 |
| 3,795,368 | 3/1974 | Larah | 239/432 |

FOREIGN PATENTS OR APPLICATIONS

| | | | |
|---|---|---|---|
| 175,956 | 9/1953 | Austria | 101/147 |
| 925,233 | 3/1955 | Germany | 101/147 |
| 710,875 | 6/1954 | United Kingdom | 101/147 |

*Primary Examiner*—Edgar S. Burr
*Assistant Examiner*—William Pieprz

[57] ABSTRACT

A device is provided for moistening the plate cylinders of offset printing machines. The device includes an inner rotatable sleeve having an air passage extending therethrough. Angularly extending passages are provided in the inner sleeve. The inner sleeve is rotatable within an outer fixed cylinder having spaced apertures all directed in the same direction. A film of water flows over the fixed cylinder. As the inner sleeve rotates air is forced through the inclined passage to force the water against a focus upon a diffuser which breaks the water up into a fine spray which is deposited upon the surface of a water cylinder so that the water is deposited from end to end thereof so that the plate is provided with a film of water throughout its length.

9 Claims, 8 Drawing Figures

CYLINDER MOISTENING DEVICE

This invention relates to an improvement in cylinder moistening apparatus designed to spread a liquid such as water onto the surface of a plate cylinder so that the thickness of the liquid film is uniform throughout the length desired.

BACKGROUND OF THE INVENTION

For a great number of years lithographing presses have been in use for printing on paper or paperboard. In this process, the water and ink are applied to predetermined surfaces of the printing plate, and the ink is then normally transferred to a blanket cylinder which acts to apply the ink to the web or sheet being printed. The plate cylinder is provided with a surface of zinc or similar material which is applied to the plate cylinder, and which may be removed when the surface to be printed is changed. The water is applied to the plate, and covers the area thereof which is not to be printed. The plate cylinder is also in contact with an ink roller which applies ink to the surfaces of the plate cylinder which are to be printed. The ink is normally transferred to a blanket cylinder which applies the ink to the sheet or web.

In general, this process is very old, and has been used for many years. However, there is one difficulty which is often experienced with this type of printing, particularly at high speeds, and that lies in the means of distributing the water in a thin film uniformly throughout the length of the cylinder.

If the cylinder bearing the film of water does not have a uniform coating throughout its length, a portion of the plate on the plate cylinder is not properly moistened, with the result that the ink is applied to a portion of the plate where it is not desired. As a result, the resulted printing material is blemished.

This invention relates to an improvement in cylinder moistening apparatus which is designed to distribute water evenly in a thin coating throughout the length of the cylinder or roller. As a result, the water is applied to the plate cylinder uniformly throughout the length of the cylinder, and many of the difficulties previously experienced with presses of this type are eliminated.

SUMMARY OF THE DISCLOSURE

A feature of the present invention resides in the provision of an ink distributing apparatus which includes a sleeve to the surface of which water is distributed evenly throughout the length of the sleeve. A second sleeve is rotatable supported within the outer sleeve, and includes a hollow core through which air is forced. The surface of the inner rotatable sleeve is provided with a series of openings therethrough which become aligned with one of a series of slots in the fixed outer cylinder and which are angled in a manner to direct air toward a predetermined focus point outwardly of the outer fixed cylinder. Air flowing through the angled openings in the inner cylinder blows water from the surface of the outer cylinder toward a spherical ball or other means which breaks the spray into fine particles, and spray the finely divided water particles onto a water cylinder through suitable orifices spaced longitudinally of the sleeves. The finely divided spray coats the entire length of the water cylinder with water, thereby acting through a series of contacting cylinders to spread an even film of water on the plate cylinder.

A feature of the present invention lies in the fact that closures may be provided for closing off the spray of water to certain of the outlets so as to coat the surface of the water cylinder throughout a predetermined length in the event the web or sheets being printed do not extend the full width of the blanket cylinder.

A further feature of the present invention lies in the fact the position of the balls against which the streams of water are directed are adjustable so that a proper distribution of water spray is obtained. The ball against which the water is directed is somewhat smaller than the orifice through which the finely divided spray extends, thereby permitting the water to be applied to the water roller throughout its entire length when desired.

A further feature of the present invention resides in the fact that while the apertures in the fixed outer sleeve are on a common plane, the air orifices in the inner rotatable cylinder are angularly spaced so that only one series of air orifices is aligned with the outlet in the outer cylinder at any point of rotation of the inner cylinder. As a result, the air pressure remains substantially constant within the rotatable cylinder, and is not suddenly increased and decreased by flow through a number of the orifices at the same time.

These and other objects and novel features of the present invention will be more clearly and fully set forth in the following specification and claims.

BRIEF DESCRIPTION OF THE PREFERRED EMBODIMENTS

Figure 1:
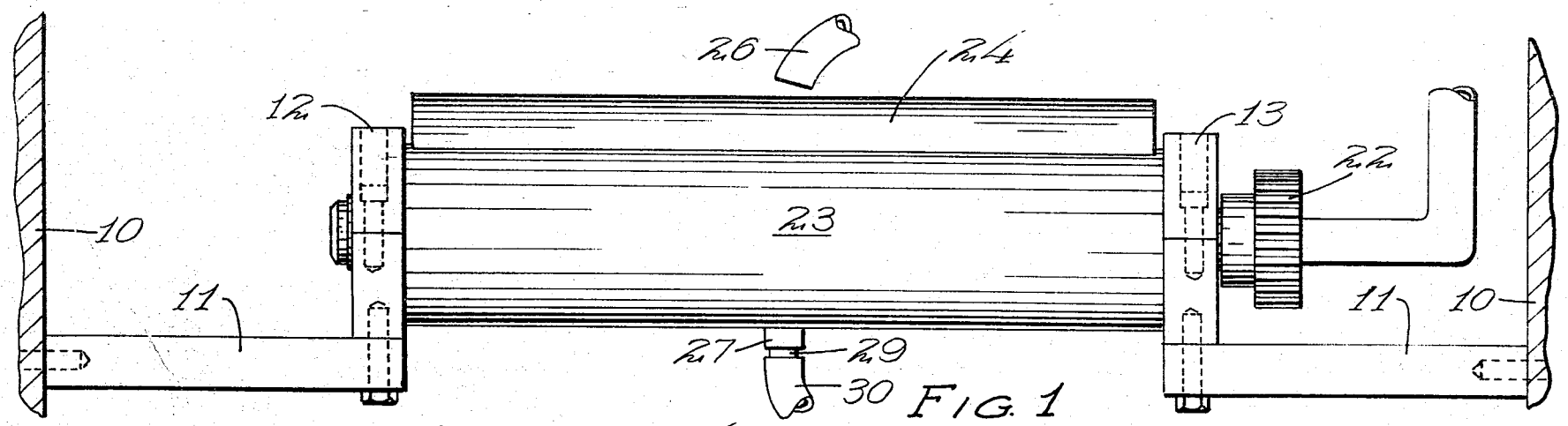
FIG. 1 is a side elevational view of the rear side of the apparatus showing the water supply to the reservoir, and showing the outlet for the water which is not used during operation. Obviously, the water may be recirculated during the operation without contamination from the press.

FIG. 1 discloses diagrammatically the press frame 10 having inwardly opposed bearing supports 11 terminating in spaced relation. Bearings 12 and 13 are mounted upon the supports 11 at the inner ends thereof, the outer races 14 and 15 of the bearings being supported by the fixed outer cylinder 16 supported by the clamps 12 and 13. The inner races 17 and 19 of the bearings 15 rotatably support the rotatable sleeve 20 having an axial passage 21 extending therethrough. A gear or pulley 22 is mounted up the projecting end of the sleeve 20, and is connected to suitable means (not shown) to rotate the sleeve 20 at a desired speed.

Figure 4:
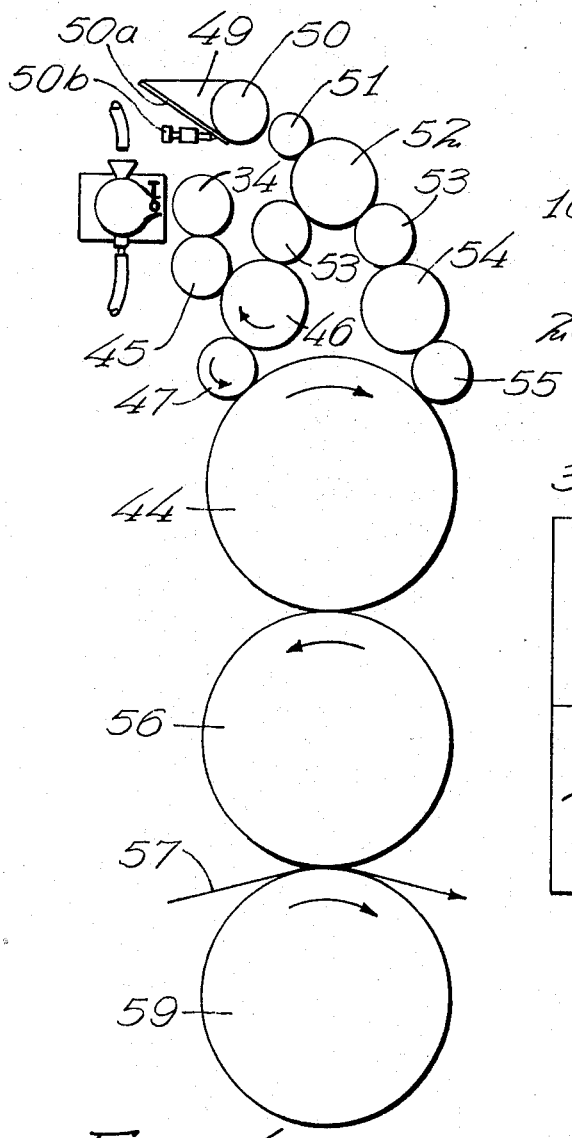
FIG. 4 is a diagrammatic view of a press showing an arrangement for ink and water to be applied to the surface of the plate cylinder.
Figure 6:
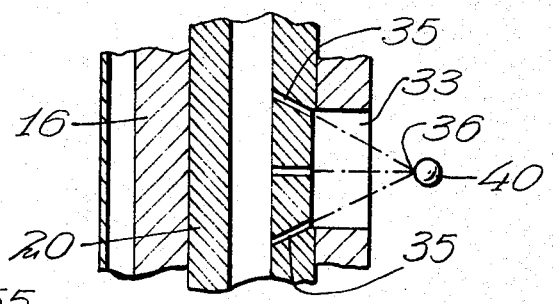
FIG. 6 is a diagrammatic view showing the spray nozzles in the rotatable inner cylinder through which air may flow so as to force water against the water diffusing ball.
Figure 5:
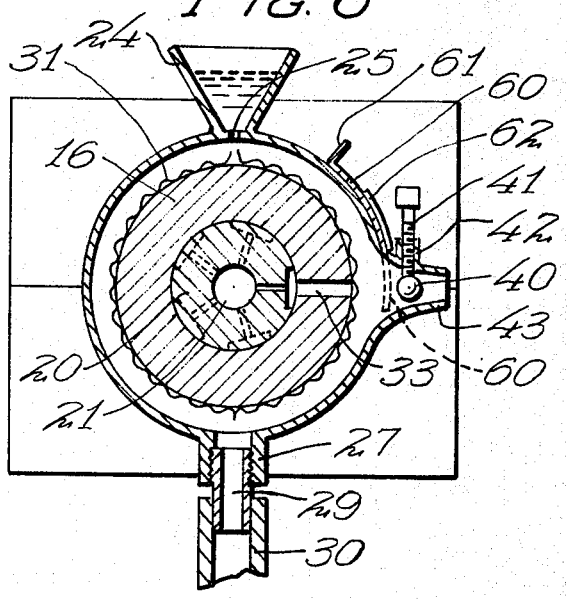
FIG. 5 is a cross-sectional view showing the water reservoir, the fixed cylinder over which the water flows, and the inner rotatable cylinder and its relation to one of the outlets in the fixed sleeve.
Figure 7:
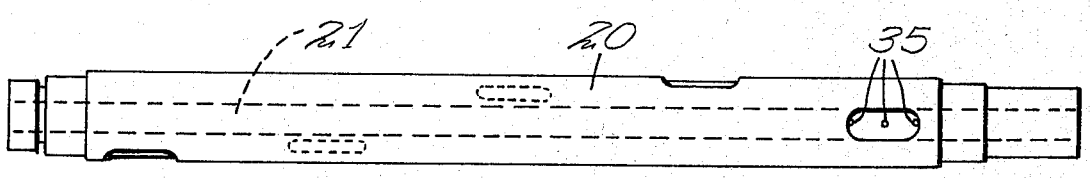
FIG. 7 is an elevational view of the inner cylinder showing the manner in which the outlets in this cylinder are angularly related.

The clamping brackets 12 and 13 support a cylinderical housing 23 having a generally V-shaped reservoir 24 (see FIG. 4) secured to its upper extremity. Apertures 25 extending through the sleeve 23 throughout the length thereof at the base of the reservoir 24 act to permit liquid to drop onto the surface of the outer sleeve 16 throughout the length thereof as shown in FIG. 5 of the drawings. Accordingly, when water from the water supply 26 flows into the reservoir 24, the water constantly flows onto the surface of the outer fixed sleeve 16 in a thin film, the excess water being drained to a water outlet 27 connected by a nipple 29 to a drain pipe 30.

The water on the surface of the sleeve 16 is indicated by the rippling line 31. Obviously, there will be but a thin film of water on the surface of the sleeve 16 in actual practice. As indicated in FIG. 5 of the drawings, the reservoir 24 is shown as generally V-shaped in cross-section with the openings 25 at the base of the reservoir.

Figure 2:
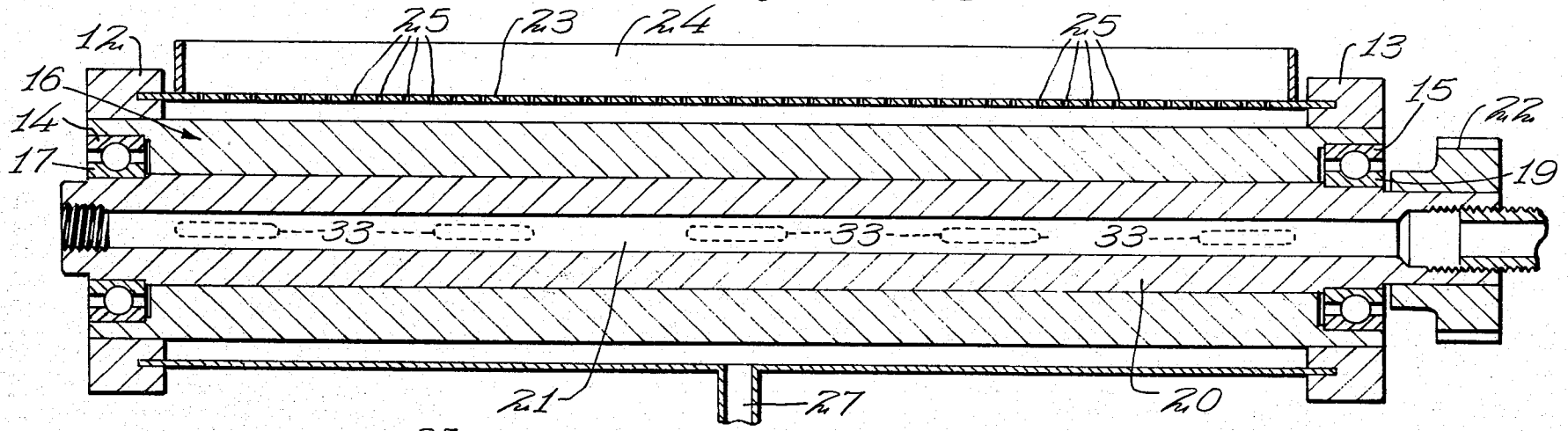
FIG. 2 is a vertical sectional view through the apparatus showing the longitudinally spaced outlets in the outer cylinder.
Figure 3:
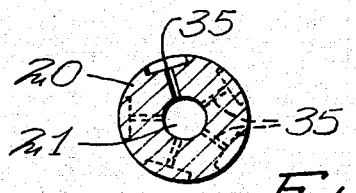
FIG. 3 is a sectional view through the rotatable inner cylinder, showing the manner in which the spray nozzles are angularly spaced.

As is indicated in FIG. 2 of the drawings, there are spaced elongated slots or apertures 33 in the outer sleeve 16. These apertures 33 are all on a common plane directed toward a water cylinder 34 upon which the water is sprayed. The inner rotatable cylinder 20 is provided with air apertures 35. The air apertures 35 are arranged so that the intermediate apertures 35 forces water directly toward the focal point 36. The center aperture 35 being at right angles to the axis of the sleeve 20 while the other apertures 35 are angularly related to intersect the stream through the central apertures 35 at the focal point 36.

A ball 40 or other diffusing device is located at the apex 36 of the air streams and acts to diffuse the liquid as a spray in all directions. The ball 40 is supported by a threaded stem 41 extending through a boss 42 which may position the ball 40 to best diffuse the liquid which is blown under force against it. This causes a finely divided spray to flow through the outlet 43 against the water roller 34. The outlet 43 acts to diffuse the water throughout the length of the cylinder 34 and the ball 40, being under the force of a water spray from three directions, tends to finely divide the water into a spray or mist which covers the entire surface of the roller 34. It should be understood that only a thin film of liquid is necessary on the roller 34 in order to moisten the plate cylinder 44 in spite of the fact the apertures 33 through the outer cylinder 16 are in spaced relation. The finely divided water particles which are formed by engagement with the ball 40 cause the water particles to extend longitudinally of the roller 34 between the openings 33. As indicated the ink is transferred to the ink roller 50 having a fountain blade 50*a* that rides against ink roll 50. The blade is adjustable with keys or thumb screws 50*b* to set the amount of ink required in a given area on the plate cylinder 44, thus getting the amount of ink needed for good coverage.

The ink roller 50 is driven by a separate electric motor (not shown in the drawings) which aids in a quick setting of the inking train. The doctor roller cam (also not illustrated) is located on the shaft of the roll 50. This gives the operator or pressman full control of the flow of ink.

The doctor roller 51 feeds the ink to the large 4 inch oscillator roller 52. The ink here is split and goes to the distribution rollers 53. The ink is transferred to each of the oscillator rollers 46 and 54 from the two rollers 53. The oscillator roller 46 in turn supplies a coating of ink to the form roller 47. The oscillator roller 54 applies to the form roller 55 which contacts the plate cylinder 44.

The water or liquid from the dampener system is controlled by the air pressure, speed of the motor, and the settings of the slide lids 60 which will be described, and to the ball 40, 41. The liquid mist or spray is transferred by air pressure to the roll 34 in the manner which has been described, and then to the roll 45. Both of the rolls 34 and 45 will have a coating of ink thereon by contact with the roll 47. The form roller 47, traveling in the direction shown by the arrows lays both the water, to keep the plate clean, and the first coverage of ink. This arrangement also keeps the moisture from creeping back up to the ink fountain and also helps to keep the form roller 55 with clean fresh ink.

It is important to note that this unit works entirely opposite of any unit known. The faster it turns, the finer the mist and a smaller amount of water is transferred. The slower it rotates, the more liquid will be transferred.

While it is well known in the art to apply a film of water to the plate cylinder prior to its engagement with the ink roller, difficulty has been experienced in controlling the film of water so that a film of uniform thickness is applied to the plate cylinder. Actual production models of the present device have definitely shown that the present device accomplishes the necessary result.

Figure 8:
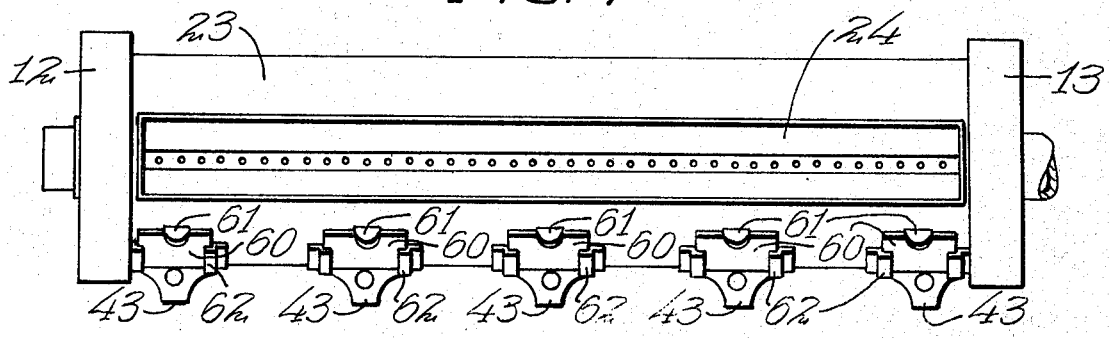
FIG. 8 is a diagrammatic top plan view of the apparatus showing the closures which may function to close the apertures in the event the plate on the plate cylinder extends only a portion of the width of the cylinder.

Means are provided for closing off the apertures 33 which are beyond the width of the web or sheet being printed. Arcuate closures 60 which are operated by out turned flanges 61 are shown in FIG. 5 and 8 guided by guides 62 so that the areas of the roller 34 which are not to be moistened may be closed off by movement of the member 61 into the dotted line position shown in FIG. 5, cutting off the flow of water to the outlet orifice 43. Any number of these apertures 33 may be cut off so that only a predetermined area of the cylinder is moistened.

In accordance with the Patent Statutes, I have described the principles of construction and operation of my Cylinder Moistening Apparatus, and while I have endeavored to set forth the best embodiments, I desire to have it known and understood that obvious changes may be made within the scope of the following claims without departing from the spirit of my invention.

I claim:

1. In a printing press, a cylinder moistening device including:

an outer hollow cylinder having a series of spaced longitudinally aligned slots in one wall thereof, a sleeve rotatable within said hollow cylinder having an air passage extending axially therethrough connected to a source of air, means for rotating said sleeve drivingly connected to said sleeve, a series of pairs of air apertures in longitudinally spaced relation in said sleeve and on angularly related radial planes through the axis of said sleeve, the pairs of apertures being serially in communication with one of said slots upon rotation of said sleeve, and extending from said air passage to said slots, said source supplying air through said air passages, apertures, and slots in accordance with the rotation of said sleeve, the apertures of each pair being directed to a common focal point, means providing a film of water over the outer surface of said cylinder and over the slots therein, and into the path of air issuing from said slots, diffusing means in the path of water blown from the outer surface of said cylinder substantially at each said focal point to diffuse the water into small particles, and a cylinder rotatably supported adjacent to said difussing means upon which said small particles are deposited.

2. The structure of claim 1 and including a third air aperture between the apertures of each pair directed toward said common focal point.

3. The structure of claim 1 and including a means adjustably supporting said difussing means.

4. The structure of claim 1 and in which said angularly extending passages in said sleeve are spaced longitudinally of the said sleeve inwardly of each of said series of spaced aligned slots.

5. The structure of claim 1 and in which said angularly spaced apertures are so arranged that only one of said series of slots and in said cylinder are in communication with said spaced aligned apertures at any angle of rotation of said sleeve.

6. The structure of claim 1 and including an outer hollow cylinder enclosing said first named cylinder and including outlets in alignment with said slots in said first named cylinder in which said diffusing means are supported.

7. The structure of claim 6 and in which said diffusing means each comprise a ball against the surface of which the water is forced.

8. The structure of claim 7 and in which said ball is adjustably supported.

9. The structure of claim 1 and in which the means providing the supply of water includes a reservoir supported above said cylinder.

* * * * *